US005257467A

United States Patent [19]

White

[11] Patent Number: 5,257,467

[45] Date of Patent: Nov. 2, 1993

[54] CARPET DRYING APPARATUS

[75] Inventor: Lawrence W. White, Mt. Vernon, Wash.

[73] Assignee: Dri-Eaz Products, Inc., Mt. Vernon, Wash.

[21] Appl. No.: 967,258

[22] Filed: Oct. 26, 1992

[51] Int. Cl.[5] ..... F26B 13/00

[52] U.S. Cl. ..... 34/151; 34/243 R; 248/316.4

[58] Field of Search ..... 34/243 R, 10, 23, 90, 34/91, 151; 392/360; 248/316.4

[56] References Cited

U.S. PATENT DOCUMENTS

| | | | |
|---|---|---|---|
| 758,303 | 4/1904 | Eckmann | 392/360 |
| 2,156,890 | 5/1939 | Wuringer | 19/72 |
| 3,035,146 | 5/1962 | Pryor | 219/39 |
| 3,286,368 | 11/1966 | Thomas | 34/151 |
| 3,324,846 | 6/1967 | Smith | 126/271.1 |
| 3,557,650 | 5/1971 | Brahm | 34/151 |
| 3,627,442 | 12/1971 | Brandt | 415/219 |
| 3,739,483 | 6/1973 | Meier-Windhorst | 34/23 |
| 3,774,261 | 11/1973 | Colt | 15/321 |
| 3,775,029 | 11/1973 | Ranz | 417/353 |
| 4,086,709 | 5/1978 | Jackson | 34/90 |
| 4,094,076 | 6/1978 | Baslow | 34/90 |
| 4,109,340 | 8/1978 | Bates | 15/321 |
| 4,145,821 | 3/1979 | Schantz | 34/237 |
| 4,151,658 | 5/1979 | Hibino et al. | 34/243 |
| 4,153,968 | 5/1979 | Perkins | 15/321 |
| 4,207,649 | 6/1980 | Bates | 15/319 |
| 4,284,127 | 8/1981 | Collier et al. | 165/35 |
| 4,336,627 | 6/1982 | Bascus | 15/321 |
| 4,443,909 | 4/1984 | Cameron | 15/320 |
| 4,777,737 | 10/1988 | Wolens et al. | 34/237 |
| 5,014,446 | 5/1991 | Reesman | 34/151 |
| 5,048,202 | 9/1991 | Shero | 34/151 |
| 5,174,048 | 12/1992 | Shero | 34/243 R |

FOREIGN PATENT DOCUMENTS 453852 12/1949 Italy .

OTHER PUBLICATIONS

Extractomatic Carpet Care Equipment by Clean-Care—Brochure.

Windjammer Carpet Dryer by Hightec—Brochure.

*Primary Examiner*—Henry A. Bennet

*Attorney, Agent, or Firm*—Christensen, O'Connor, Johnson & Kindness

[57] ABSTRACT

Apparatus for drying damp carpet and carpeting materials is disclosed. The apparatus includes a blower (22) for blowing air under the carpet, and a clamp (24) affixed to the blower (22), for securing the carpet to the blower (22). The blower (22) includes a blower housing (26) with a head (28) having air intake openings (32) and a sleeve (30) that forms an air outlet opening (36); and a powered fan (34) attached within the head (28) of the blower housing (26) for blowing air out of the sleeve opening (36). The clamp (24) comprises a mounting bracket (44) affixed to the blower housing (26), a rod (46) slidably coupled to the mounting bracket (44) and a restraint mechanism (54) for preventing the rod (46) from sliding upward away from the carpet. The restraint mechanism (54) is attached to the mounting bracket (44). The clamp (24) also includes a foot (48) attached at the lower end of the rod (46) for holding the carpet against the sleeve (30) of the blower housing (26). The apparatus can be used to dry carpeting materials simply by placing an edge of the carpet between the clamp foot member (48) and the housing sleeve (30), applying force to the clamp rod (46) in the direction of the housing sleeve (30), and securing the restraint mechanism (54) such that the clamp (24) holds the carpet in place. The blower (22) can then be activated to force air from the sleeve (30) underneath the carpet. Another aspect of the invention is a clamp (24) adapted to be attached to a blower (22), for holding the carpet as described above.

20 Claims, 3 Drawing Sheets

CARPET DRYING APPARATUS

FIELD OF THE INVENTION

This invention relates generally to a blower apparatus for drying carpeting materials and, more particularly, to an improved blower apparatus employing a clamp assembly to secure the carpet to the blower during use in drying the carpeting materials.

BACKGROUND OF THE INVENTION

To avoid costly damage, wet carpeting materials must be dried in a timely and effective manner. Left wet too long, or not completely dried, carpeting materials can be ruined by mildew. To deal with this problem, many carpet drying techniques have been developed.

Carpet cleaning machines have been used in a suction mode to remove water from carpeting materials. However, water damage to carpets is often caused by flooding or water leaks that tend to penetrate to the bottom of the carpeting, into both the pad and carpet backing. Removing enough water to be truly effective with a carpet cleaning machine would be difficult at best. Any substantial amount of water left beneath or within the carpeting materials can easily destroy the materials over a short period of time.

High-powered fans have been employed to blow streams of air over the carpeting materials to increase the evaporation rate of the water in the carpet. However, this method is not very effective in completely drying the carpeting.

Removal of carpeting materials for drying has also been employed. This method can effectively dry the carpeting materials, but is substantially more difficult, and therefore, expensive to perform.

Finally, blowers have been used to dry wet carpeting by blowing very high volumes of air between the carpet and the padding. The outlet with a high capacity blower is positioned between the bottom of the carpet and the top of the pad, with the carpet typically overlying or flopped over at least part of the blower housing. However, even with this method, difficulties often arise. One difficulty that severely decreases the effectiveness of this method is the tendency of the carpet to be blown off or away from the blower, precluding a strong air flow from being maintained between the carpeting materials. This problem can occur if a high-powered blower produces sufficient force to blow the carpet off or away from the blower, allowing air to spill out around the blower instead of being forced under the carpet. Solutions to this problem have been attempted, including attaching a fork-like appendage on which to stick the carpet, to the head of the blower housing. Not only can this fork-like appendage be a dangerous protrusion and damage the carpeting, but it also does not tightly hold the carpet to the blower outlet to effectively channel the air flow. In addition, the carpet does not always remain on the forked appendage. Another device to hold the carpet uses a spring-loaded wire clamp attached to the blower. The wire clamp pushes down over the blower outlet in an effort to hold the carpet therebetween. The ability of this mechanism to effectively grip the carpet is marginal at best. Also, if a spring is used that is stiff enough to hold the carpet to the blower outlet, the difficulty of manually retracting the spring to safely and effectively place the carpet beneath the spring is increased substantially.

In consideration of the limitations and disadvantages of the device currently in use, it should be apparent that an effective solution to the problem of drying wet carpeting materials by being able to easily secure a wet carpet to a blower is not provided in the known prior art. Accordingly, the present invention was developed, and it provides significant advantages over previous devices for securing and drying carpeting materials.

SUMMARY OF THE INVENTION

In accordance with this invention, a device for drying carpet and carpeting materials is provided that comprises a blower and a clamp. The blower includes a blower housing with an air intake opening and a sleeve that forms an air outlet opening, and a powered fan attached within the housing for blowing air from the outlet opening. The clamp includes a mounting bracket affixed to the blower housing, a rod slidably coupled to the mounting bracket to press the carpet against the top of the blower outlet sleeve. A restraint mechanism, attached to the mounting bracket, prevents the rod from sliding in a direction away from the carpeting material, and a structural foot member is attached to the lower end of the rod for holding the carpet against the sleeve of the blower housing.

In accordance with a particular aspect of this invention, the mounting bracket comprises a rigid-walled body that defines a channel guide, having a longitudinal axis within which the rod is slidably engaged, parallel to the longitudinal axis. The rigid-walled body is mountable to the blower housing.

In accordance with another aspect of this invention, the structural foot member comprises an extension of the rod deformed to define a foot portion. Another embodiment of the structural foot member comprises a cross bar attached to the bottom of the rod to form an inverted T-shape. Still another embodiment includes a plate attached to the bottom of the rod for pressing against the carpet.

In accordance with another aspect of this invention, the structural foot member includes a friction-increasing shoe attached to a lower portion of the structural foot member. In one embodiment, the shoe is made of rubber with a coefficient of friction higher than that of the structural foot member. In another embodiment, the shoe is made of teeth formed in the bottom of the structural foot member.

In accordance with another aspect of this invention, in one embodiment, the restraint mechanism comprises a thumbscrew having threads that match threads in the rigid-walled body, such that the thumbscrew can be tightened against the rod to hold it in place. In another embodiment, the restraint mechanism comprises a ratchet and pawl mechanism. In still another embodiment, the restraint mechanism comprises threads encircling the rod, which match threads in the main bore of the rigid-walled body, such that the entire rod can be translated up or down by turning it.

In accordance with another aspect of this invention, the top surface of the blower sleeve includes a ridge extending across a portion of its width, parallel to the air outlet opening. This sleeve ridge increases the friction of the carpeting material when the clamp is in use.

BRIEF DESCRIPTION OF THE DRAWINGS

The foregoing aspects and many of the advantages of this invention will become more readily appreciated as the present invention becomes better understood by reference to the following detailed description, when taken in conjunction with the accompanying drawings, wherein.

DETAILED DESCRIPTION OF THE PREFERRED EMBODIMENT

Figure 1:
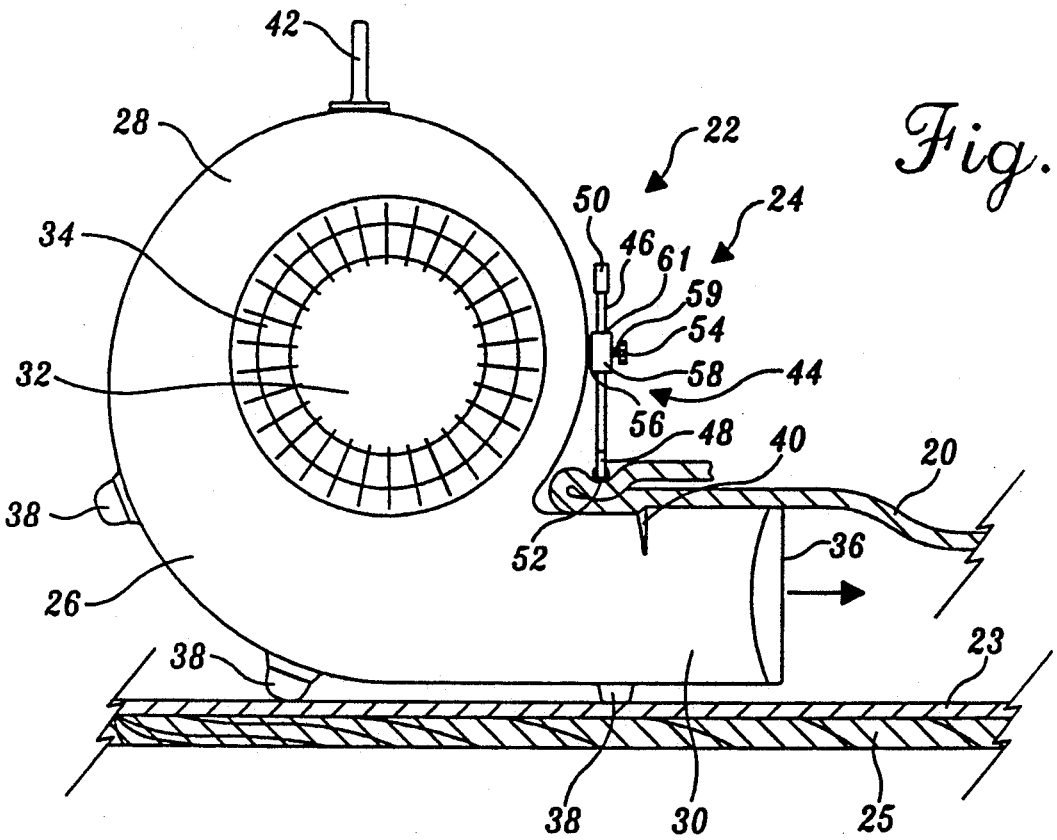
FIG. 1 is a side elevational view of the invention, showing the blower and clamp assembly and illustrating its use in clamping and drying a carpet.
Figure 2:
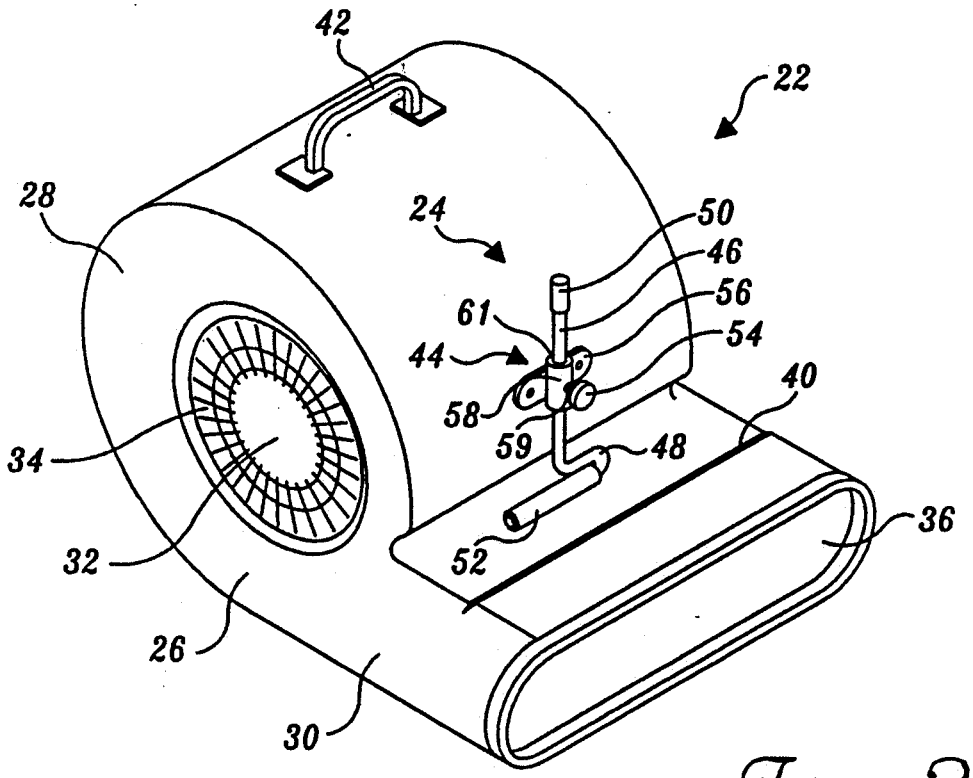
FIG. 2 is a perspective view of the blower and clamp assembly of the invention.

A first preferred embodiment of the carpet drying apparatus is illustrated in FIGS. 1 and 2. A section of a carpet 20 is shown having a corner folded over and secured to a blower 22. Carpet padding 23 and floor 25 are shown in FIG. 1, and it should be understood that blower 22 may be used to dry the padding as well. Padding 23 is disposed beneath the carpet such that blower 22 blows air between carpet 20 and the padding. A clamp 24 is also illustrated in FIG. 1. Clamp 24 secures carpet 20 against blower 22 such that when blower 22 is activated, carpet 20 remains securely fastened to the top of blower 22. In this manner, the air flow from the blower effectively travels in a desired path beneath carpet 20 and does not push aside the corner of carpet 20, which might allow the air to flow out of its desired path. Blower 22 includes a housing 26 having a head 28 and a sleeve 30. A powered fan 34 is mounted within housing 26. When powered fan 34 is activated, air is pulled in air intake opening 32 and blown from air outlet opening 36 at high speed beneath carpet 20. As air blows from air outlet opening 36, it lifts and flows beneath carpet 20. This flow of air exerts a force on carpet 20 in a direction upward and away from blower 22. Clamp 24 effectively holds carpet 20 securely to blower 22 to prevent carpet 20 from being blown off blower 22. This configuration forces the air flow to travel beneath carpet 20 to dry carpet 20 and any other carpeting materials such as padding.

Also connected to housing 26 is handle 42 and housing support members 38. Handle 42 is for carrying and positioning blower 22 and is of conventional configuration. It is secured to the top of housing head 28 with screws or may be integrally formed with housing head 28. Housing support members 38 serve as feet upon which blower 22 stands.

Further details of housing 26 are also illustrated in FIG. 2. A ridge 40 extends across the top surface of sleeve 30. Ridge 40 runs substantially parallel to air outlet opening 36 and is offset slightly from clamp 24 toward air outlet opening 36. When clamp 24 is employed to hold carpet 20 to sleeve 30, ridge 40 increases the friction on carpet 20 and thereby increases the combined holding ability of clamp 24 and blower housing 26 on carpet 20.

Clamp 24 comprises a bracket 44, a rod 46, a cap 50, a foot 48, and a shoe 52. Bracket 44 is illustrated as including a rigid-walled body 58 having a threaded cross opening 59 in its side; and a thumbscrew 54 engaged in threaded opening 59. When tightened, thumbscrew 54 prevents movement of rod 46 within body 58. Rigid-walled body 58 forms a channel or slideway 61 having a longitudinal axis. Bracket 44 also includes attachement wings 56 affixed to rigid-walled body 58 and extending outwardly in opposite directions therefrom. Attachment wings 56 are used to secure bracket 44 to housing 26, bracket 44 being oriented so that the longitudinal axis of channel 61 is substantially perpendicular to the top of housing sleeve 30.

Clamp 24 is employed to secure carpet 20 against sleeve 30 by applying a force to the top of cap 50 in the direction of the carpet. The user then tightens thumbscrew 54 so as to keep rod 46 from rotating or retracting upward. Foot 48, which is attached to the lower end of rod 46, presses shoe 52 against carpet 20 tightly, so that carpet 20 does not slip past shoe 52 or ridge 40 on sleeve 30.

The details of preferred and alternate embodiments of the apparatus will now be described. Since similar elements run from one embodiment to the next, successive letters (a, b, c . . . ) will be added to numbers used with the elements that appear in more than one embodiment to clarify the embodiment that is being discussed.

Figure 3:
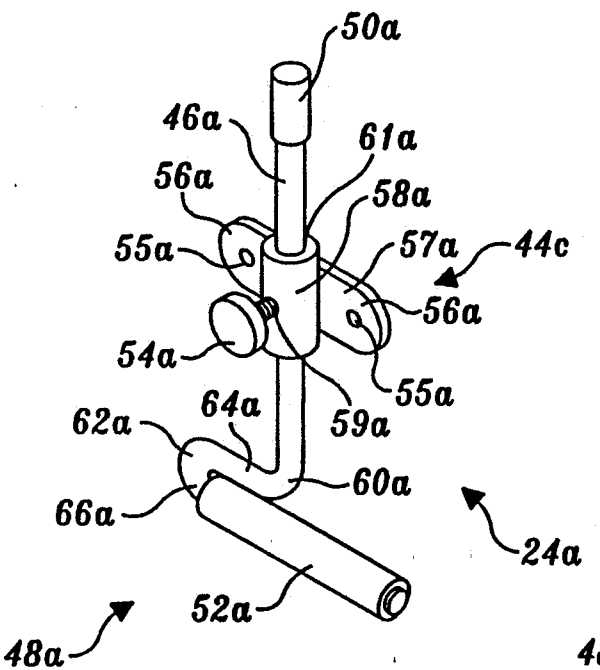
FIG. 3 is a perspective view of the preferred embodiment of the clamp separate from the blower.

FIG. 3 illustrates the preferred embodiment of a clamp 24*a* in greater detail. Attachment wings 56*a* comprise an attachment plate 57*a*. Attachment plate 57*a* has an oblong shape with rounded ends and substantially parallel sides. Near the rounded ends, wing holes 55*a* are formed into which screws may be inserted for attachment to housing 26 of blower 22. A rigid-walled body 58*a* is securely affixed to attachment plate 57*a*. In the preferred embodiment, a weld is used to affix these two members together, but any other method may be used or these two members can be made as a unitary member, for instance, by powder metal molding. Rigid-walled body 58*a* is essentially cylindrical in shape, with a longitudinal throughbore 61*a* and a threaded opening 59*a* in its wall. The threads of threaded opening 59*a* match those on a thumbscrew 54*a* that is thus held in the threaded opening.

A rod 46*a* is slidably engaged with rigid-walled body 58*a*. The diameter of rod 46*a* is slightly smaller than the inside diameter of the throughbore of the rigid-walled body 58*a* such that rod 46*a* can be freely slid along the longitudinal axis of channel 61*a* within rigid-walled body 58*a*. Free sliding motion of the rod is allowed unless the inner end of thumbscrew 54*a* is tightened against rod 46*a* sufficiently to secure rod 46*a* against sliding. A cap 50*a* is engaged over the top of rod 46*a*. In the preferred embodiment, cap 50*a* is made of vinyl or similar suitable material and is sized to fit snugly over the end of rod 46*a*, providing an enlarged, cushioned area against which a user can comfortably apply pressure to rod 46*a*. Rod 46*a* also extends beneath rigid-walled body 58*a*, where it is bent to define a transverse foot 48*a*. The foot is formed by bending rod 46*a* at a 90° bend 60*a* to form a transverse rod section 64*a*, followed by a 180° bend 62*a* to form a second transverse rod portion 66*a* that serves as the structural foot member of foot 48*a*. A shoe 52*a* is then engaged over second portion 66*a* of foot 48*a* to add additional friction on carpet 20 when clamp 24*a* is in use. In the embodiment shown in FIG. 3, shoe 52*a* is composed of rubber or similar or suitable material having a coefficient of friction higher than that of foot 48*a*.

Figure 4:
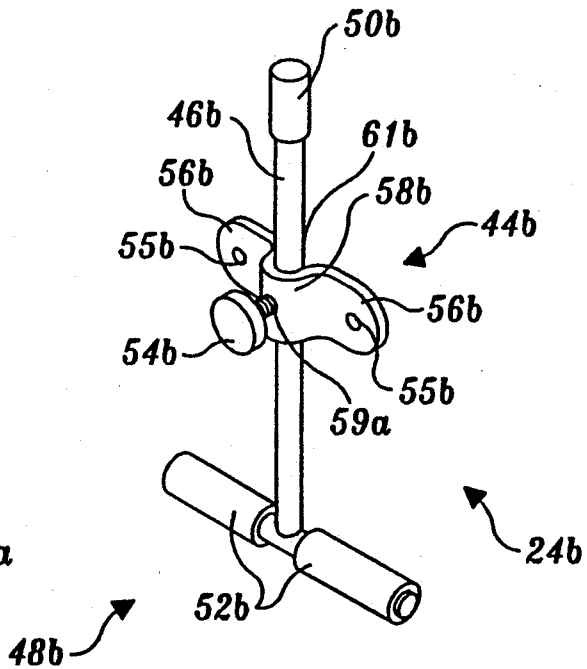
FIG. 4 is a perspective view of an alternate embodiment of the clamp, showing an alternate bracket and an alternate foot and shoe portion.

FIG. 4 illustrates an alternate embodiment of a clamp 24*b*. The differences between this embodiment and the embodiment illustrated in FIG. 3 reside in a bracket 44*b*, a foot 48*b*, and shoes 52*b*. Bracket 44*b* comprises a U-shaped rigid-walled body 58*b* that forms a channel or slideway 61*b* in which a rod 46*b* is engaged. Attachment wings 56*b* extend outwardly from opposite sides of the U-shaped, rigid-walled body 58*b*. Holes 55*b* are formed in the ends of attachment wings 56*b* for securing bracket 44*b* to blower housing 26. When bracket 44*b* is secured to housing 26, clockwise rotation of a thumbscrew 54*b* brings the end of the thumbscrew into contact with rod 46*b* and pushes rod 46*b* against blower housing 26. In this manner rod 46*b* is secured against movement relative to bracket 44*b* and housing 26.

FIG. 4 also illustrates an alternate embodiment of foot 48*b*. In this embodiment, foot 48*b* is in the form of a cross bar welded or otherwise attached at its center to the bottom of rod 46*b* in a transverse orientation. Shoes 52*b* are engaged on the ends of foot 48*b*. Shoes 52*b* are of rubber or other suitable material, with a coefficient of friction higher than that of foot 48*b* so as to effectively grip carpet 20 when foot 48*b* forces shoes 52*b* against carpet 20.

Figure 5:
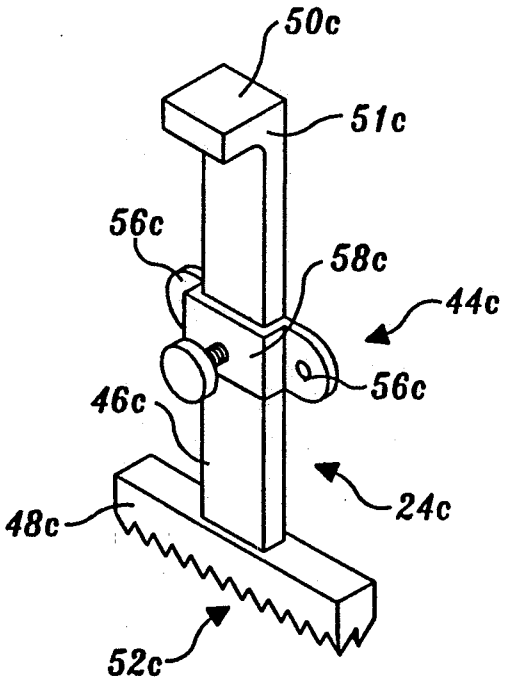
FIG. 5 is a perspective view of an alternate embodiment of the invention, showing a rod with a rectangular cross section and teeth on the bottom of the foot portion.

FIG. 5 shows still another embodiment of a clamp 24*c*. Most elements are slightly altered in this embodiment although the functioning of clamp 24*c* in this embodiment is essentially the same as in the prior described embodiments. A rod 46*c* has a rectangular cross section and is integral with a cap 50*c*. A 90° bend 51*c* at the top of rod 46*c*, in a direction away from housing 26, forms cap 50*c*. The cap provides a convenient and comfortable place on which to apply pressure to rod 46*c* in the direction of sleeve 30. A bracket 44*c* is also modified to be used with the rectangular (or square) cross-sectional shape of rod 46*c*. Thus, a rigid-walled body 58*c* is formed into a U-shaped member having square corners. Attachment wings 56*c* and a thumbscrew 54*c* are essentially the same as the corresponding elements illustrated in FIG. 4. A foot 48*c* is in the form of a bar having a rectangular cross section, welded or otherwise attached at its center to the bottom of rod 46*c* in a perpendicular orientation to form an inverted T-shape with the rod 46*c*. Instead of using rubber or other friction material to form a shoe, teeth 52*c* are formed on the bottom of foot 48*c*. Teeth 52*c* perform the same function of increasing the friction between clamp 24*c* and carpet 20 when clamp 24*c* is in use to secure the carpet.

Figure 6:
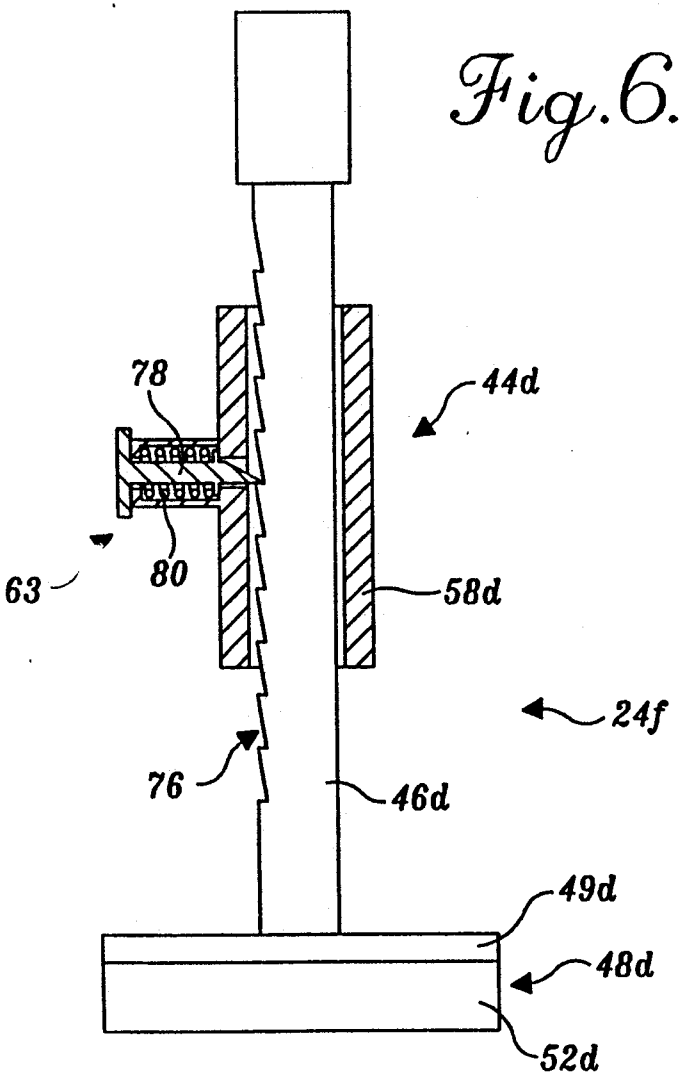
FIG. 6 is a perspective view of an alternate embodiment of the invention, illustrating a ratchet and pawl mechanism as well as a foot plate and shoe.

FIG. 6 illustrates still other embodiments of a bracket 44*d* and a foot 48*d* of a clamp 24*d*. In this embodiment, bracket 44*d* comprises a cylinder 58*d* with a pawl and ratchet mechanism 63 to restrain a rod 46*d* from upward movement relative to bracket 44*d* and housing 26. Ratchet teeth 76 are formed on rod 46*d* and a pawl 78 is pivotally coupled to cylinder 58*d* with a compression spring 80 to bias pawl 78 in the direction of engagement with ratchet teeth 76.

A slightly different embodiment of foot 48*d* is also illustrated in FIG. 6. In this embodiment, foot 48*d* comprises a plate 49*d* attached to the bottom of rod 46*d* in a plane perpendicular to the length of rod 46*d*. A shoe 52*d* is shaped and sized to closely match plate 49*d* and is composed of rubber or other suitable material having a relatively high coefficient of friction. Other elements of clamp 24*d* in this embodiment are similar to those already described.

Figure 7:
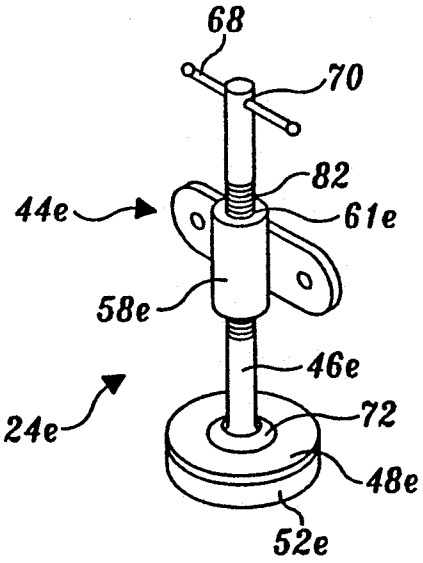
FIG. 7 is a front elevational view of an alternate embodiment of the invention, illustrating a threaded rod and cylinder arrangement.

FIG. 7 illustrates an alternate embodiment of a clamp 24*e* having means to restrain a rod 46*e* from vertical movement. In this embodiment, rod 46*e* has threads 82 and a cylinder 58*e* has a bore 61*e* with matching threads to engage threads 82 of rod 46*e*, such that rotation of rod 46*e* causes longitudinal movement of rod 46*e* relative to a bracket 44*e*. Instead of a cap at the top of rod 46*e*, a rod handle 68 is coupled to rod 46*e* through a cross hole 70 formed in the top of rod 46*e*. Cross hole 70 has a major axis perpendicular to a longitudinal axis of rod 46*e* such that rod handle 68, when disposed within hole 70, also has an orientation perpendicular to that of the longitudinal axis of rod 46*e*. A rotatable connector 72 connects the bottom end of rod 46*e* to a foot 48*e* so that rotation of rod 46*e* does not cause rotation of foot 48*e* and an attached shoe 52*e*. The connector 72 may be in the form of a socket formed in the center of the footplate 48*e* and an enlarged ball formed in the bottom of rod 46*e*.

Figure 8:
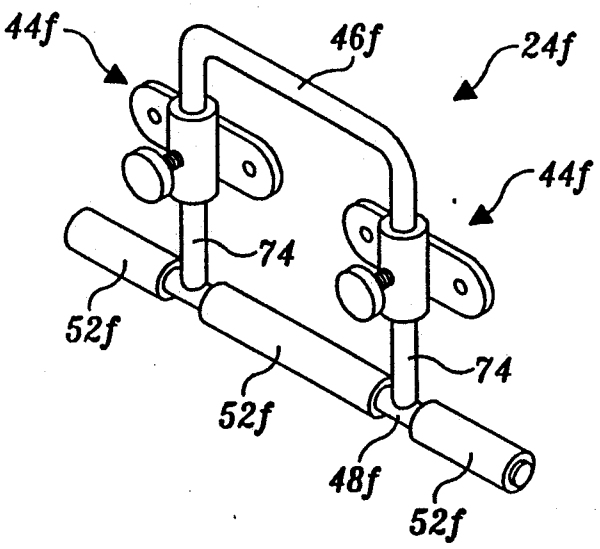
FIG. 8 is a front elevational view of an alternate embodiment of the invention, illustrating a rod configuration having two legs.

Finally, another embodiment of a clamp 24*f* is shown in FIG. 8. In this embodiment, a rod 46*f* is bent into a large U-shaped member to form two legs 74. These legs are coupled to two brackets 44*f*. Brackets 44*f* are similar to those illustrated in FIGS. 1–6 and restrain rod 46*f* from upward movement in a manner similar to the embodiments already disclosed. A foot 48*f* is similar to that shown in FIG. 4, except that in this embodiment, foot 48*f* is affixed to both legs 74. A shoe 52*f* is disposed on foot 48*f*, being of rubber or other suitable high friction material as in the embodiment shown in FIG. 4.

All of the embodiments described above share distinct advantages. By using clamp 24 as configured in any of the embodiments described, carpeting material can be securely held to the top surface of blower outlet sleeve 30. The positive grip of clamp 24 on carpet 20 ensures that carpet 20 is not blown off or away from sleeve 30. Holding the carpet in this manner forces the air flow out of air outlet opening 36 to travel beneath carpet 20. Clamp 24 is also easy to use to secure carpet 20 in place on blower 22. The user simply places a fold of carpet 20 between foot 48 and sleeve 30, forces foot 48 with shoe 52 down against carpet 20 by pushing cap 50 in the direction of sleeve 30 and uses bracket 44 to secure rod 46 in place such that carpet 20 is securely gripped between shoe 52 and blower outlet sleeve 30. Ridge 40 also aids in securing carpet 20, since carpet 20 bends around ridge 40 when clamp 24 applies a downward force upon it. This apparatus does not require the user to pull back on a heavy metal spring or suffer the hazards associated with a forked appendage.

Several alternate embodiments of the invention have been shown and described. It should be clear that the elements shown in these various embodiments, to a large extent, can be mixed and matched to provide other embodiments. For example, shoe 52*c* (with teeth) illustrated in FIG. 5 could just as well be employed in the embodiment illustrated in FIG. 4, or pawl and ratchet mechanism 63 of FIG. 6 could be used in the embodiment illustrated in FIG. 5. One can also easily imagine equivalent substitute means to carry out the function of many of the elements disclosed. For example, a small plate or bar affixed to the top of rod 46 could be used instead of cap 50, or a vinyl shoe with spikes could be used in place of any of the embodiments of shoe 52 disclosed. Therefore, while the preferred embodiment of the invention has been illustrated and described, along with several alternative embodiments, it will be appreciated that various other changes can be made therein without departing from the spirit and scope of the invention.

The embodiments of the invention in which an exclusive property or privilege is claimed are defined as follows:

1. Apparatus for drying carpet and carpeting materials, said apparatus comprising:
   a. a blower for blowing air under the carpet, said blower comprising:
      i. a blower housing including a sleeve that forms an air outlet opening;
      ii. a powered fan within the blower housing for blowing air out of the outlet opening; and
   b. a clamp, affixed to the blower housing, for securing the carpet to the blower, the clamp comprising:
      i. a mounting bracket mountable on the blower housing;
      ii. a rod slidably coupled to the mounting bracket, the rod having a lower end portion extending toward the blower sleeve, an upper end extending in a direction away from the blower sleeve, and a longitudinal axis;
      iii. restraint means for preventing the rod from sliding in a direction aligned with the longitudinal axis of the rod, the restraint means being attached to the mounting bracket; and
      iv. foot means, attached to the lower end portion of the rod, for holding the carpet against the sleeve of the blower housing.

2. The apparatus of claim 1, wherein the mounting bracket comprises a rigid-walled body that defines a channel within which the rod is slidably engaged to move in the direction aligned with the longitudinal axis of the rod, the lower end portion of the rod protruding out of the rigid-walled body; and attachment means for affixing the rigid-walled body to the blower housing;

wherein the foot means comprises a structural foot member attached to the lower end portion of the rod, the structural foot member being oriented generally transversely to the rod; and friction means, attached to the structural foot member, for increasing the gripping ability of the foot means.

3. The apparatus of claim 2, wherein the rod has a circular cross section and the rigid-walled body comprises a cylinder having an inside diameter slightly larger than an outside diameter of the rod.

4. The apparatus of claim 3, wherein the restraint means comprises a threaded portion on the rod and a matching threaded portion on the inside of the cylinder.

5. The apparatus of claim 2, wherein the restraint means comprises a threaded screw and wherein the rigid-walled body forms a threaded cross opening oriented generally transversely to the longitudinal axis to receive the threaded screw.

6. The apparatus of claim 2, wherein the restraint means comprises a ratchet means attached to the rigid-walled body and corresponding ratchet teeth formed over at least a portion of the length of the rod.

7. The apparatus of claim 2, wherein the rigid-walled body comprises a rigid member forming a generally "U" cross-sectional shape; and wherein the attachment means comprise extensions attached to the "U"-shaped rigid member.

8. The apparatus of claim 2, wherein the structural foot member comprises an extension of the rod, deformed to define a foot portion.

9. The apparatus of claim 8, wherein the friction means comprises a surface material, having a coefficient of friction higher than that of the structural foot member, disposed on the foot portion.

10. The apparatus of claim 2, wherein the structural foot member comprises a bar attached to the lower end of the rod and oriented generally transversely to the rod.

11. The apparatus of claim 2, wherein the structural foot member comprises a plate attached to the lower end portion of the rod and oriented generally transversely to the rod.

12. The apparatus of claim 2, wherein the friction means comprises a surface material having a coefficient of friction higher than that of the structural foot member.

13. The apparatus of claim 2, wherein the friction means comprises teeth protruding from the lower portion of the structural foot member.

14. The apparatus of claim 1, wherein the rod has an upper end portion above the restraint means, and further comprising a cap attached to the upper end portion of the rod for covering the upper end of the rod and for providing a place on which to apply pressure to the rod in the direction of the lower end of the rod.

15. The apparatus of claim 2, wherein the outlet sleeve of the blower housing has a top side, the top side including a ridge disposed across at least a portion of the width of the sleeve for increasing the friction on the carpet when the structural foot member holds the carpet against the top side of the sleeve.

16. The apparatus of claim 1, wherein the rod has a polygonal cross-sectional shape.

17. Apparatus for securing a material to a drying machine, the apparatus comprising:
   a. a mounting bracket adapted to be attached to the drying machine, the mounting bracket including a channel having a longitudinal axis, a forward end disposed to face the material, and a rearward end opposite the forward end;
   b. an elongate member slidably engaged within the channel in a generally parallel orientation with respect to the longitudinal axis, said elongate member having a lower end portion extending toward the drying machine and an upper end portion opposite the lower end portion;
   c. elongate member securing means, attached to the mounting bracket, for preventing the elongate member from moving in the channel along the longitudinal axis; and
   d. foot means attached to the lower end portion of the elongate member for contacting the material to be secured and holding the material against the drying machine.

18. The apparatus of claim 17, wherein the mounting bracket comprises:
   a. an attachment means for securing the mounting bracket to the drying machine; and
   b. a sleeve affixed to the attachment means, the sleeve defining the channel.

19. The apparatus of claim 17, wherein the elongate member comprises a rod.

20. The apparatus of claim 17, wherein the foot means comprises:
   a. a structural foot member having a top side and a bottom side, the top side being attached to the rod; and
   b. a friction surface disposed on the bottom side of the structural foot member, for gripping the material to be secured to the drying machine.

* * * * *

UNITED STATES PATENT AND TRADEMARK OFFICE

CERTIFICATE OF CORRECTION

PATENT NO. : 5,257,467
DATED : November 2, 1993
INVENTOR(S) : Lawrence W. White

It is certified that error appears in the above-indentified patent and that said Letters Patent is hereby corrected as shown below:

| COLUMN | LINE | |
|---|---|---|
| 2 | 2 | "device" should read --devices-- |
| 4 | 14 | "attachement" should read --attachment-- |
| 8 (Claim 10 | 9 Line 2) | after "end" insert --portion-- |

Signed and Sealed this

Twelfth Day of April, 1994

*Attest:*

BRUCE LEHMAN

*Attesting Officer*

*Commissioner of Patents and Trademarks*